US009777422B2

(12) United States Patent
Kim

(10) Patent No.: US 9,777,422 B2
(45) Date of Patent: Oct. 3, 2017

(54) DETERGENT CASE APPARATUS FOR WASHING MACHINE

(71) Applicant: Dongbu Daewoo Electronics Corporation, Seoul (KR)

(72) Inventor: Jeong Hyeon Kim, Anyang-si (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 683 days.

(21) Appl. No.: 14/080,662

(22) Filed: Nov. 14, 2013

(65) Prior Publication Data

US 2014/0159559 A1 Jun. 12, 2014

(30) Foreign Application Priority Data

Dec. 7, 2012 (KR) ..... 10-2012-0141935

(51) Int. Cl.

| | |
|---|---|
| ***D06F 39/02*** | (2006.01) |
| ***D06F 39/12*** | (2006.01) |
| *D06F 37/42* | (2006.01) |

(52) U.S. Cl.
CPC ..... *D06F 39/02* (2013.01); *D06F 39/12* (2013.01); *D06F 37/42* (2013.01)

(58) Field of Classification Search
CPC ..... D06F 39/02; D06F 39/022; D06F 39/028
See application file for complete search history.

(56) References Cited

FOREIGN PATENT DOCUMENTS

| | | | | |
|---|---|---|---|---|
| FR | EP 0808937 A1 * | 11/1997 | ..... | D06F 39/02 |
| GB | 2139002 A * | 10/1984 | ..... | G05G 1/02 |

OTHER PUBLICATIONS

Machine Translation of Ambrosio, EP 0808937 A1, Nov. 1997.*

* cited by examiner

*Primary Examiner* — David Cormier

(57) ABSTRACT

Disclosed is a detergent case apparatus for a washing machine, including a detergent case configured to be opened and closed, and having a hanging part; a button in or on the washing machine body; and a case fixing apparatus configured to confine a movement of the detergent case by operation of the button.

7 Claims, 8 Drawing Sheets

DETERGENT CASE APPARATUS FOR WASHING MACHINE

CROSS-REFERENCES TO RELATED APPLICATIONS

The present application claims priority under 35 U.S.C 119(a) to Korean Application No. 10-2012-0141935, filed on Dec. 7, 2012, in the Korean Intellectual Property Office, which is incorporated herein by reference in its entirety.

BACKGROUND

Exemplary embodiments of the present invention relate to an apparatus for a washing machine, and more particularly, to a detergent case apparatus for a washing machine capable of preventing an accident where a child extracts or removes the detergent case outside the washing machine and takes detergent from the detergent case.

Generally, a drum type washing machine is an apparatus that washes laundry using water while rotating a drum by a driving force of a motor, in which detergent, washing water, and laundry are placed or injected into the drum.

The drum type washing machine includes a housing or cabinet forming an outer appearance, a cylindrical tub in the housing and into which the washing water is put, a rotatable cylindrical drum in the tub to wash the laundry, a driving motor and a rotating shaft on a back portion of the tub to rotate the drum, and a door mounted on a front portion of the housing.

An upper front portion of the housing is provided with a detergent case in which a detergent is stored and a back portion thereof is provided with a washing water supply pipe which receives the washing water from the outside and supplies the received washing water to the detergent case.

The washing water passing through the inside of the detergent case is introduced into the tub through a feed pipe which connects the detergent case to an upper portion of the tub. The water enters the drum in the tub and contacts the laundry.

An inner circumference of the drum is provided with a plurality of lifters which protrude inwardly and are spaced from each other. When the drum rotates, the drum performs the washing by applying a physical force to the laundry while the laundry and the washing water are lifted upward by a lifter, and then fall downward into the wash water and detergent.

Front portions of the tub and the drum are provided with openings, and thus when the door is opened, the laundry may be put in the drum and taken out from the drum through the openings. When the door is closed, the tub and the drum are sealed from the outside, such that the laundry may be washed by the supply of the washing water and the rotation of the drum.

The washing water after the washing process is discharged outside the tub through a drainage pump and a drain pipe.

As the related art, there is Korean Utility Model No. 0173177 (Registered on Dec. 17, 1999, Title: The Structure of Water Supply and a Cleaner Case for a Washing Machine).

Generally, the front surface of the drum type washing machine is provided with the detergent case which may be pulled forward from the washing machine body to open the detergent case, and the detergent is put in the open detergent case. A washing operation is started when the detergent case with detergent therein is pushed into the washing machine body.

Since the existing drum type washing machine is not provided with a separate locking apparatus which confines the detergent case or prevents its removal or opening, a child may extract, remove or open the detergent case on the front portion of the drum type washing machine and takes detergent from in the detergent case, which may result in an accident.

SUMMARY

One or more embodiments of the present invention are directed to a locking apparatus for a detergent case for a washing machine capable of preventing an accident in which a child extracts, opens or removes the detergent case outside the washing machine and takes detergent from the detergent case, by providing a locking function which confines the detergent case and prevents its easy opening or removal.

One or more embodiment(s) of the present invention relates to an apparatus for a washing machine, including a detergent case configured to be opened and closed (e.g., inserted into and at least partially removed from a washing machine body), and comprising a hanging part; a button in or on the washing machine body; and a case fixing apparatus configured to lock to the hanging part and confine movement of the detergent case by operation of the button.

The button may include a button part having an end exposed outside the washing machine body; a moving part in the washing machine body and connected to the button part; and a guide in the washing machine body and configured to guide movement of the moving part.

The button part may be on a side portion, an upper portion, or a back portion of the washing machine body and be exposed outside the washing machine body.

The moving part may include a support configured to be connected to the button part in the washing machine body; a rail(s) on one side or portion of the support, extending in a moving direction of the support, and configured to abut to the guide; and a contact projection on another side or portion of the support and configured to abut to the case fixing apparatus.

The guide may include one or more first guide hooks or brackets extending in the moving direction of the support and configured to abut or contact one side of the support; a second guide hook or bracket in parallel with the first guide hole and configured to abut or contact the other side of the support; and a guide projection or rail in parallel with the one or more first guide hooks or brackets and the second guide hook or bracket and configured to abut or contact the rail(s).

The case fixing apparatus may include a rotating shaft in the washing machine body; a rotating hook configured to couple with the rotating shaft and having one end abutting to the hanging part; and a lever configured to connect to another end of the rotating hook, abut to the button, and move the hook towards and away from the hanging part while rotating by interlocking with the button.

The case fixing apparatus may further include a pressure member configured to apply pressure or a force to the rotating hook or the lever to maintain contact between the hook and the hanging part.

BRIEF DESCRIPTION OF THE DRAWINGS

The above and other aspects, features and other advantages will be more clearly understood from the following detailed description taken in conjunction with the accompanying drawings, in which.

DESCRIPTION OF SPECIFIC EMBODIMENTS

Figure 1:
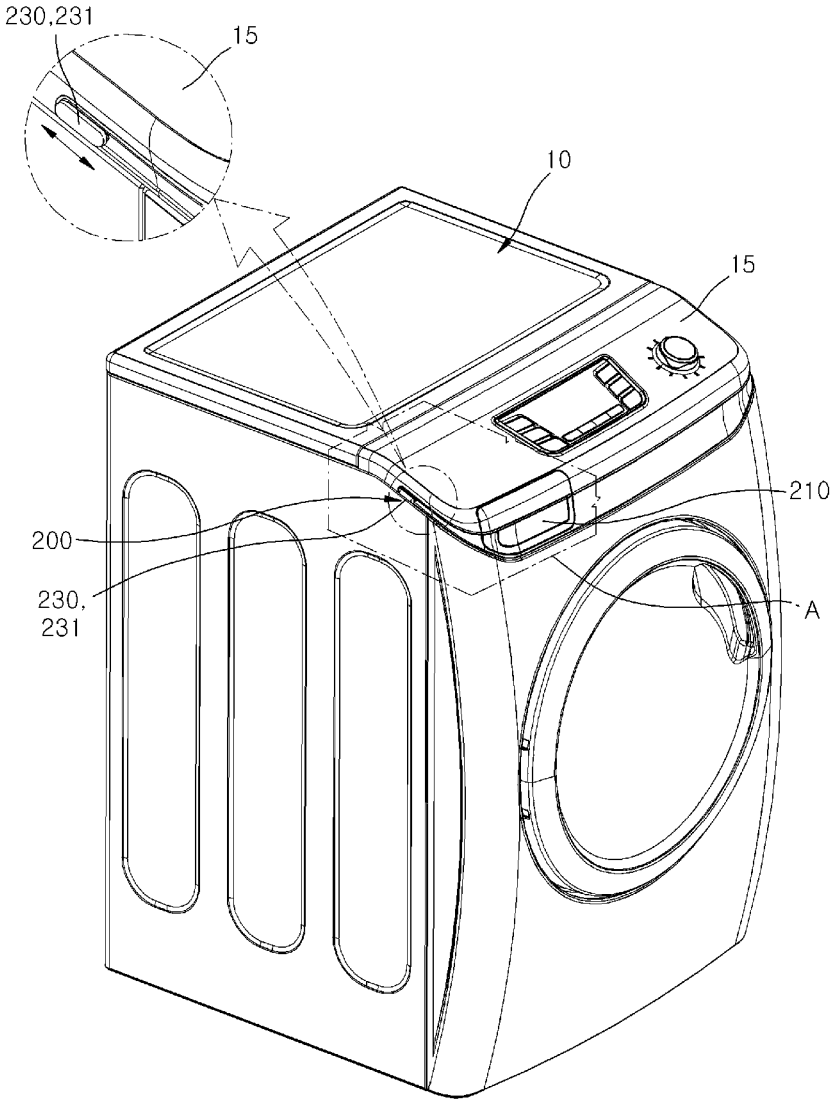
FIG. 1 is a perspective view illustrating a washing machine including an exemplary detergent case apparatus in accordance with one or more embodiments of the present invention.

Hereinafter, a detergent case apparatus for a washing machine in accordance with one or more embodiments of the present invention will be described with reference to the accompanying drawings. During the process, a thickness of lines, a size of components, or the like, illustrated in the drawings may be exaggeratedly illustrated for clearness and convenience of explanation.

Further, the following terminologies are defined in consideration of the functions in the present invention and may be construed in different ways by intention or practice of users and operators. Therefore, the definitions of terms used in the present description should be construed based on the contents throughout the specification.

Figure 2:
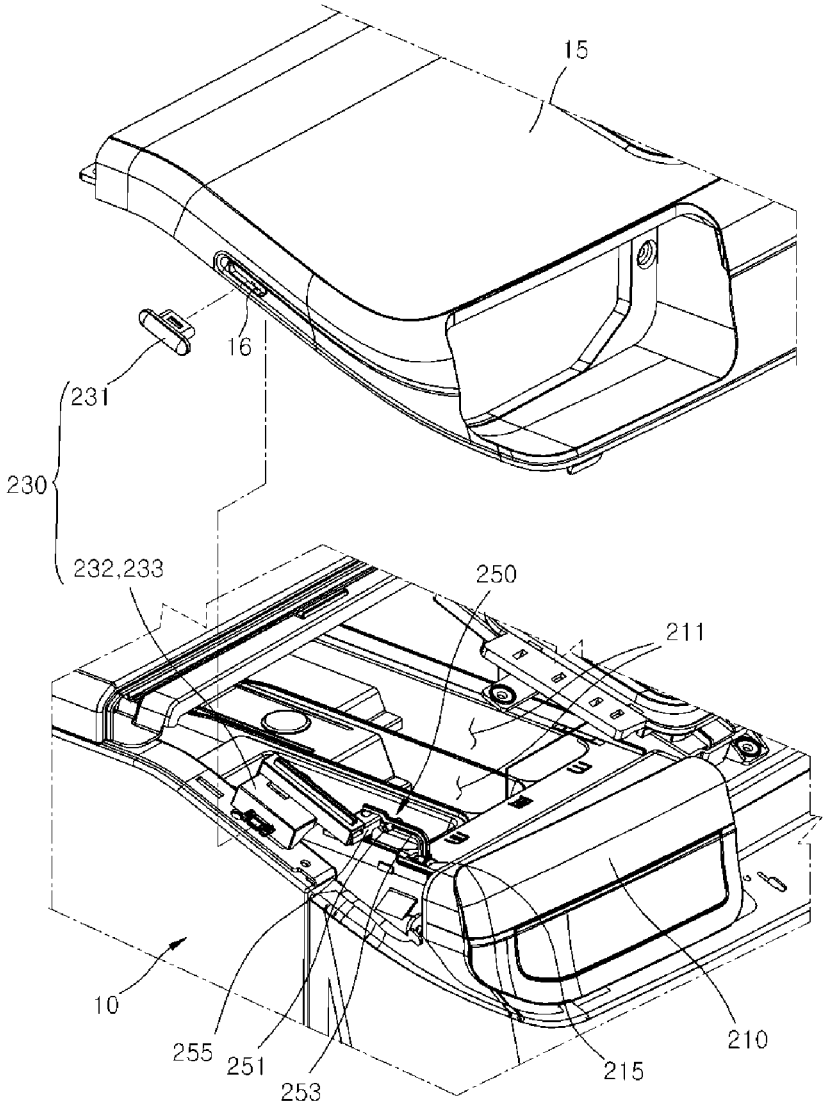
FIG. 2 is an exploded perspective view of main parts of the exemplary detergent case apparatus for a washing machine in accordance with embodiment(s) of the present invention in region A of FIG. 1.

FIG. 1 is a perspective view illustrating a washing machine including an exemplary detergent case apparatus for a washing machine in accordance with one or more embodiments of the present invention, and FIG. 2 is an exploded perspective view of main parts of the exemplary detergent case apparatus for a washing machine in accordance with embodiment(s) of the present invention, in region A of FIG. 1.

Figure 3:
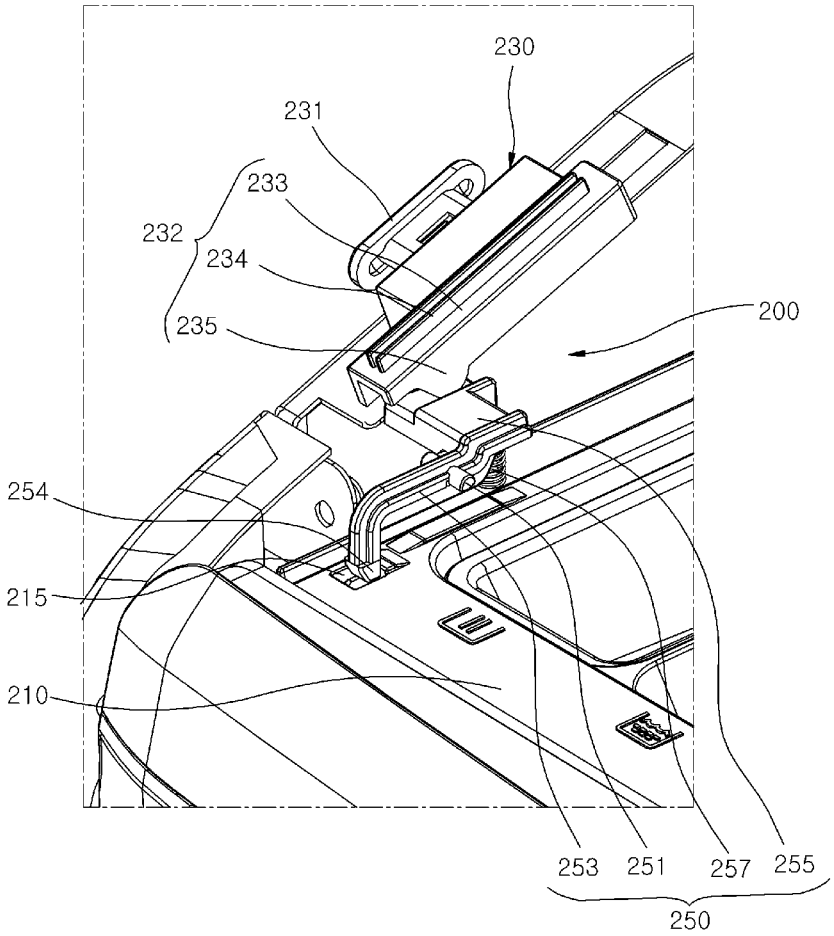
FIG. 3 is a perspective view illustrating the exemplary detergent case apparatus for a washing machine in accordance with embodiment(s) of the present invention.
Figure 4:
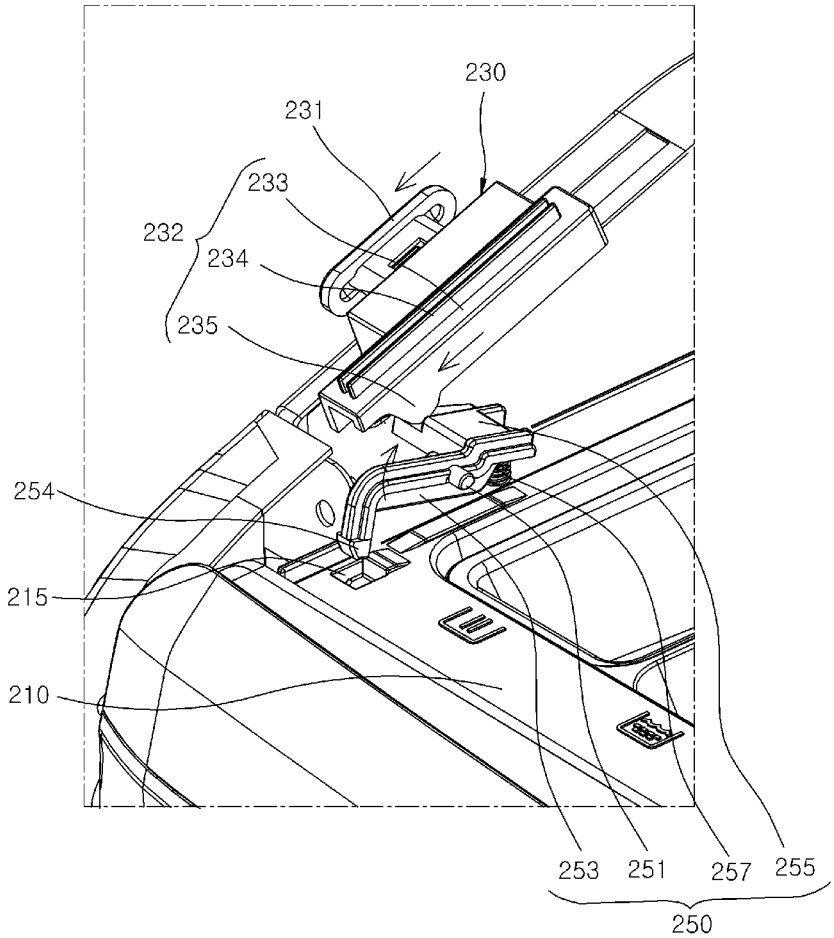
FIG. 4 is a perspective view illustrating an exemplary operation of the detergent case apparatus for a washing machine in accordance with embodiment(s) of the present invention.

FIG. 3 is a perspective view illustrating the exemplary detergent case apparatus for a washing machine in accordance with embodiment(s) of the present invention, and FIG. 4 is a perspective view illustrating an exemplary operation of the detergent case apparatus for a washing machine in accordance with embodiment(s) of the present invention.

Figure 5:
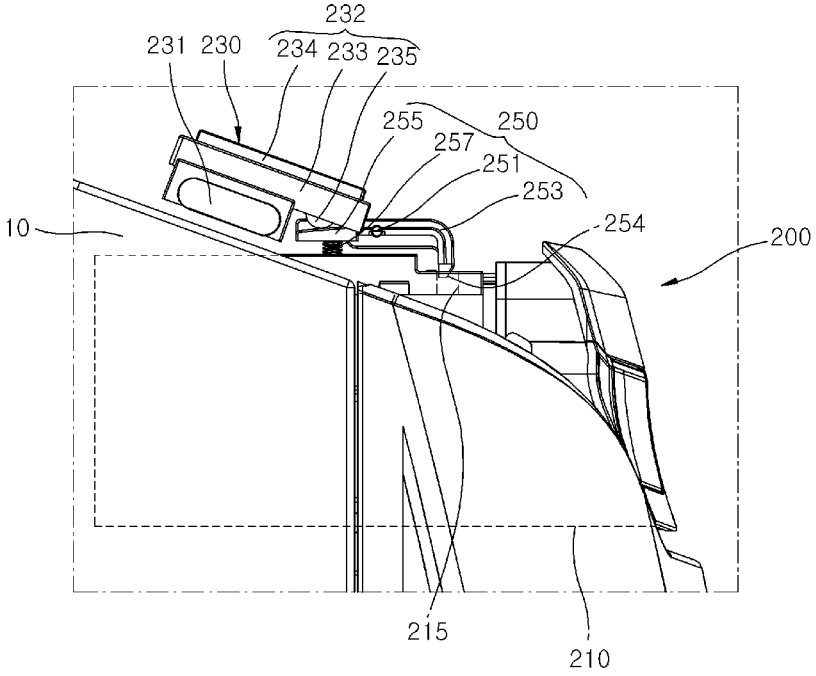
FIG. 5 is a side view illustrating the exemplary detergent case apparatus for a washing machine in accordance with embodiment(s) of the present invention.
Figure 6:
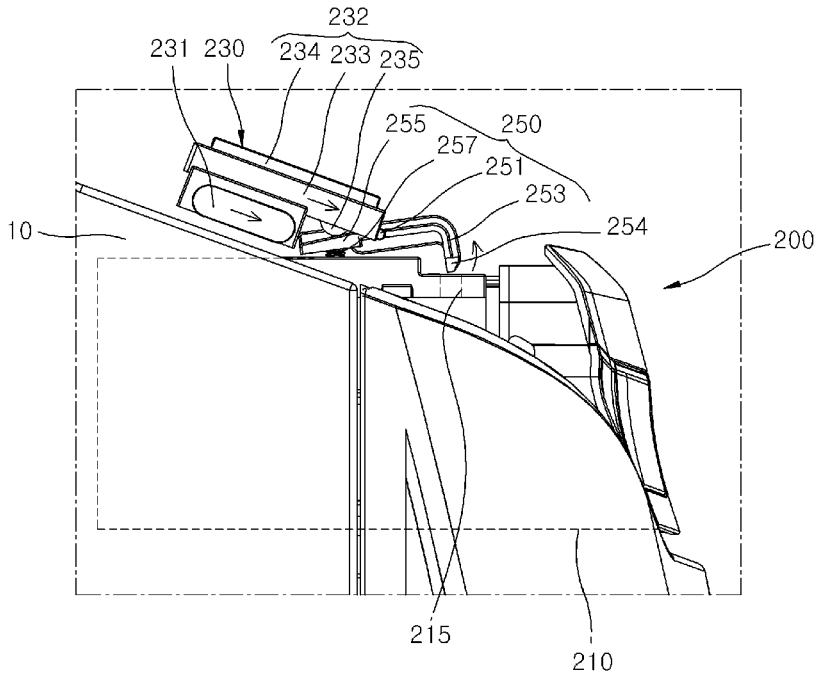
FIG. 6 is a side view illustrating further operation of the exemplary detergent case apparatus for a washing machine in accordance with embodiment(s) of the present invention.

FIG. 5 is a side view illustrating the exemplary detergent case apparatus for a washing machine in accordance with embodiment(s) of the present invention, and FIG. 6 is a side view illustrating an exemplary operation of the exemplary detergent case apparatus for a washing machine in accordance with embodiment(s) of the present invention.

Figure 7:
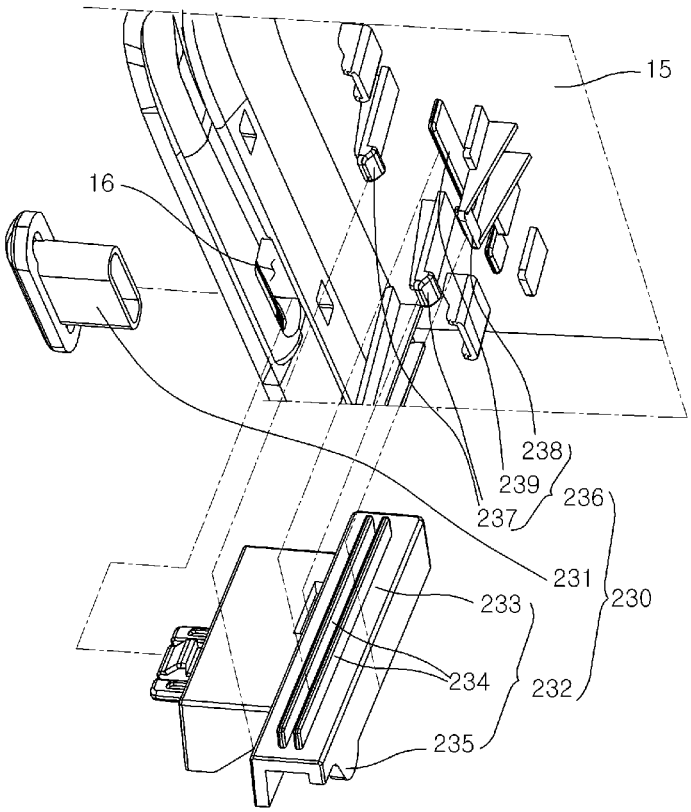
FIG. 7 is an assembly view illustrating an exemplary assembling structure of a button for a detergent case apparatus in accordance with embodiment(s) of the present invention.
Figure 8:
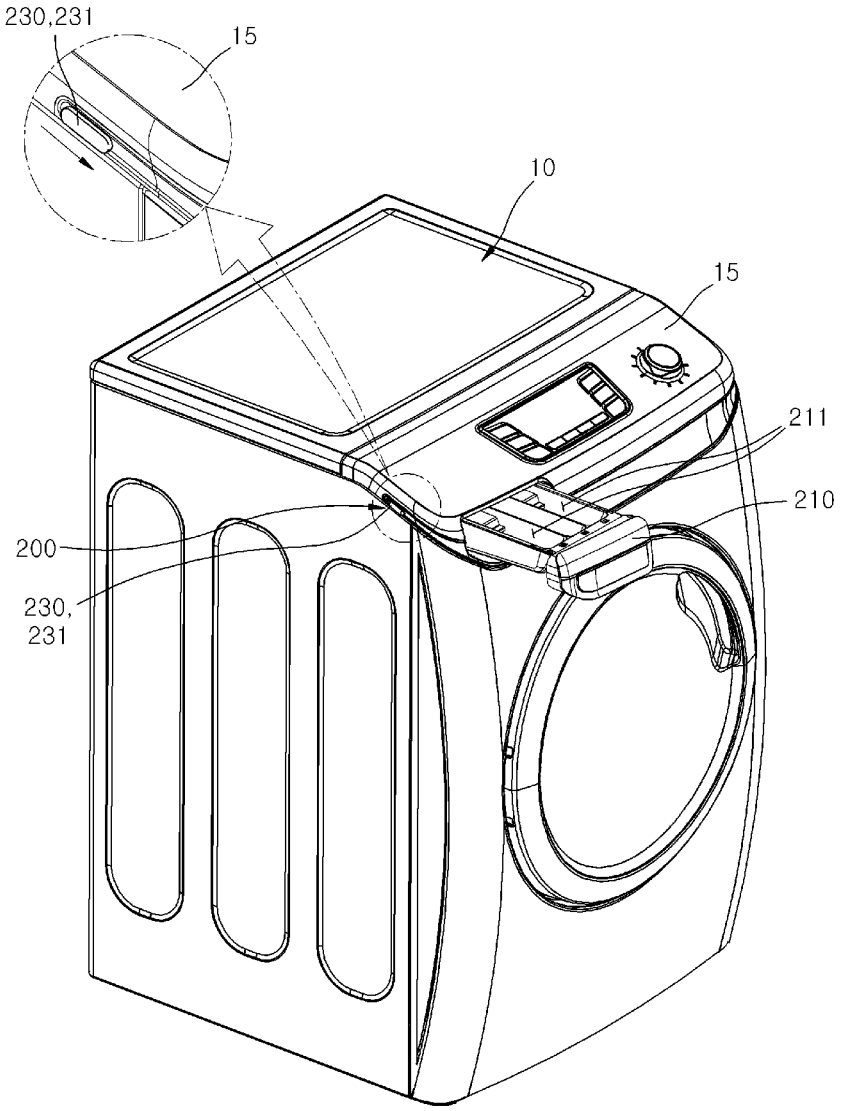
FIG. 8 is a perspective view illustrating an open detergent case in a washing machine in accordance with one or more embodiments of the present invention.

FIG. 7 is an assembly view illustrating an assembled structure of a button for the exemplary detergent case apparatus in accordance with embodiment(s) of the present invention, and FIG. 8 is a perspective view illustrating an open detergent case in a washing machine in accordance with one or more embodiments of the present invention.

Referring FIGS. 1 to 3 and 8, a detergent case apparatus 200 for a washing machine in accordance with one or more embodiments of the present invention includes a detergent case 210, a button 230, and a case fixing apparatus 250.

The detergent case 210 is mounted in a washing machine body 10 as illustrated in FIG. 1, while including a receiving part 211 (see FIG. 8) in which a detergent is put.

The detergent case 210 is retractably mounted in the washing machine body 10 as illustrated in FIGS. 1 and 8.

The detergent case 210 slidably moves into the washing machine body 10 as illustrated in FIG. 1 by an external force applied to an exterior surface of the detergent case 210 and/or inside of the washing machine body 10. Further, the detergent case 210 is slidably extracted or (partially) removed from the washing machine body 10 as illustrated in FIG. 8 by an external force applied to an interior surface of the detergent case 210 (e.g., underneath or inside a handle) and/or an outside of the washing machine body 10.

The detergent case 210 has a hanging part 215 which abuts to or receives the case fixing apparatus 250 or an end thereof. In accordance with embodiment(s) of the present invention, the hanging part 215 may be in the form of a groove or opening and may have a substantially square or rectangular shape (e.g., with angled or rounded corners) into which an end of a rotating hook 253 (see FIG. 3) on the case fixing apparatus 250 may fit. Alternatively, both the hanging part 215 and the end of the rotating hook 253 may have a round or oval shape, or any other shape configured to fit or mate with the other component.

As illustrated in FIGS. 1 and 2, when the end of the rotating hook 253 of the case fixing apparatus 250 is in the hanging part 215, and the detergent case 210 is in the washing machine body 10, the detergent case 210 is hung to or caught on the rotating hook 253, and movement of the detergent case 210 is confined. By this configuration, the detergent case 210 cannot be opened (e.g., extracted from or moved outside the washing machine body 10).

The button 230 is in the washing machine body 10 at a position apart from the detergent case 210. The button 230 includes a button part 231 which may be operated outside the washing machine body 10 by a user.

As illustrated in FIG. 8, the detergent case 210 is open (e.g., forward of the washing machine body 10), and the button part 231 may be on a part of portion of the washing machine body 10 different from the detergent case 210. For example, the button part 231 may be exposed on a side portion, a back portion, and/or an upper portion of the washing machine body 10, rather than the front portion thereof.

Here, the front portion of the washing machine body 10 means a portion or surface on which a door D is mounted. Therefore, the side or side portion of the washing machine body 10 means a left or right side or portion of the washing machine body 10 with reference to the surface or portion on which the door D is mounted, which is referred to herein as the front surface or portion of the washing machine body 10. Likewise, the upper surface/portion and the back surface/portion of the washing machine body 10 means the upper surface or portion and the back surface or portion of the washing machine body 10, respectively, with reference to the surface or portion on which the door D is mounted.

In general, the front surface or portion of the washing machine body 10 of the drum type washing machine has a laundry inlet through which a laundry is put in the drum, a door, and an operation panel. Therefore, the front portion of the washing machine body 10 is in a position that the user approaches most conveniently. Further, the side portion(s) and the back portion of the washing machine body 10 face a direction that is more difficult for the user to approach, as compared with the front surface or portion.

Therefore, when the button part 231 is on the side portion, the back portion, or the upper portion of the washing machine body 10, it may be more difficult for a child to operate the button part 231 and thus release the locked detergent case 210 than when the button part 231 is on the front surface or portion of the washing machine body 10.

In particular, when the button part 231 is exposed toward a direction different from the direction in which the detergent case 210 is removed or extracted, it may be difficult to figure out that the detergent case 210 and the button part 231 are connected to each other if the user is not familiar with or does not learn the function of the button part 231.

Further, when the button part 231 is on the upper portion or surface of the washing machine body 10, a child's field of vision may not reach the button part 231 due to the child's height. Also, the child's hand may not be able to reach the button part, and the child may not be able to operate the button part 231 and may abandon further attempted operation of the button part 231.

In accordance with embodiment(s) of the present invention, the detergent case 210 may be extracted, removed or opened only by continuously extracting, removing or opening the detergent case 210 (e.g., in the forward direction or in front of the washing machine) while operating (e.g., pressing) the button part 231 on the side of the washing machine body 10.

As described above, when the button part 231 is at a position different from the detergent case 210, or the button part 231 faces a position or direction different from the extraction or opening direction of the detergent case 210, the accidental opening of the detergent case 210 by a child may be prevented.

The case fixing apparatus 250 abuts to or is spaced from the hanging part 215 in the detergent case 210 and interlocks with the operation of the button 230.

When one side or portion of the case fixing apparatus 250 interlocks with the button 230, another portion (e.g., an opposite end) of the case fixing apparatus 250 abuts to or rotates away from the hanging part 215, and movement (that is, the extraction or opening) of the detergent case 210 may be confined, or the confinement thereof may be released.

Referring to FIG. 7, the button 230 in accordance with embodiment(s) of the present invention includes a button part 231, a moving part 232, and a guide 236.

The button part 231 receives a force or pressure from the user, and an end thereof is exposed outside the washing machine body 10 so that the user may operate the button part 231.

The button part 231 penetrates through a slot 16 in the detergent case 210 on the upper front surface of the washing machine body 10, or a side portion of a front cover 15 covering components on the upper portion thereof.

One end of the button part 231 is exposed through the front cover part 15, and another (e.g., opposite) end of the button part 231 is in, behind or below the front cover 15 and connected to the moving part 232.

The slot 16 has a straight, rectangular or oval shape, and the button part 231 moves through the slot 16 by the user's operation and/or force when the button part 231 penetrates through the slot 16.

The moving part 232 is mounted in the washing machine body 10 and is connected to the button part 231.

The moving part 232 moves with the same displacement, together with the button part 231, by the external operation and/or force applied to the button part 231.

The guide 236 is configured to guide the movement of the moving part 232 along a straight path, is in the washing machine body 10, and extends in a moving direction of the moving part 232.

Referring to FIGS. 3 to 7, the moving part 232 in accordance with embodiment(s) of the present invention includes a support 233, a rail(s) 234, and a contact projection 235.

The support 233 is a part connected to the button part 231 in the washing machine body 10 and one side portion thereof is provided with a connection part with the button part 231.

The support 233 moves straight, forward and backward along the side of the washing machine body 10 inside the washing machine body 10, together with the button part 231.

Further, the support 233 forms a frame on which the rail(s) 234 and the contact projection 235 may be formed.

In accordance with embodiment(s) of the present invention, the rail(s) 234 and the contact projection 235 are respectively on the upper portion and bottom portion of the support 233.

The rail(s) 234 are configured to abut to or contact the guide 236 which guides the movement of the support 233 and moves along an extending direction of the guide 236 together with the support 233 when the rail(s) 234 abut or contact the guide 236.

The guide 236 extends in the moving direction of the button part 231 and the support 233, that is forward and backward (e.g., to the front of the washing machine and back to its original position), and the rail(s) 234 extend in parallel with the guide 236.

Therefore, the rail(s) 234 may stably slide forward and backward while abutting the guide 236.

The contact projection 235 may protrude downward from a lower portion of the support 233 and have a rounded or a semi-circular shape. The contact projection 235 abuts to or contacts a lever 255 in the case fixing apparatus 250.

The contact projection 235 moves forward and backward together with the support 233, and a contact state or contact position between the contact projection 235 and the lever 255 in the case fixing apparatus 250 varies, depending on the position of the button part 231.

As illustrated in FIGS. 3 and 4, the case fixing apparatus 250 has an end or latch inserted into or removed from the hanging part or opening 215 in the detergent case 210, depending on the position of the contact projection 235.

Referring to FIG. 7, the guide 236 in accordance with embodiment(s) of the present invention includes one or more first guide hooks or brackets 237, a second guide hook or bracket 238, and a guide projection or rail 239.

The first guide hooks or brackets 237, the second guide hook or bracket 238, and the guide projection or rail 239 protrude or extend towards the front cover of the washing machine body 10.

The front cover 15 is over the moving part 232, and the guide 236 protrudes or extends downward from a bottom portion of the front cover 15 and abuts or contacts the moving part 232.

In accordance with embodiment(s) of the present invention, the support 233 may have a straight and/or bar shape (e.g., rectangular), or a hexahedral block shape, which is configured to extend forward and backward, and which may be movably mounted forward and backward.

The first guide hooks or brackets 237 extend at a position corresponding to one side of the support 233, and contact a surface of the one side of the support 233. The first guide hooks or brackets 237 have a surface in parallel with the moving direction of the support 233.

The second guide hook or bracket 238 is at a position corresponding to another (e.g., opposite) side of the support 233, in parallel with the first guide hooks or brackets 237, and thus, in contact with the other side of the support 233. The second guide hook or bracket 238 have a surface in parallel with the moving direction and/or one side of the support 233.

The guide projection or rail 239 is at a position corresponding to the rail(s) 234, in parallel with the first guide hooks or brackets 237 and the second guide hook or bracket 28. The guide projection or rail 239 may contact one or more surfaces of the rail(s) 234.

The rail(s) 234 form a groove having a slit or elongated rectangular shape, into which the guide projection or rail 239 may be inserted. A pair of rails 234 may abut or contact sides of the guide projection or rail 239. The rail(s) 234 may protrude or extend upward from the support 233.

Opposed sides of the support 233 abut or contact the first guide hooks or brackets 237 and the second guide hook or bracket 238, and the rail(s) 234 moves straight, forward and backward, interlocking with the operation of the button part 231 as the rail(s) 234 abut or contact sides of the guide projection or rail 239.

That is, the moving part 232 may move forward and backward in a stable and/or straight manner as the moving part 232 abuts or contacts the guide 236 in at least three places (e.g., the first guide hooks or brackets 237, the second guide hook or bracket 238, and the guide projection or rail 239).

Referring to FIGS. 3 to 6, the case fixing apparatus 250 in accordance with embodiment(s) of the present invention includes a rotating shaft 251, a rotating hook 253, a lever 255, and a pressure member or spring 257.

The rotating shaft 251 is mounted in the washing machine body 10 between the detergent case 210 and the moving part 232.

The rotating hook 253 is coupled or integral with, or connected to the rotating shaft 251, and one side or portion thereof extends to the hanging part 215, and another (e.g., opposite) side or portion of the case fixing apparatus 250 extends to the contact projection 235, perhaps based on the coupling part with the rotating shaft 251.

As illustrated in FIG. 3, one end of the rotating hook 253 extending to the hanging part or opening 215 includes a hook or latch 254, which may fit in the hanging part 215.

The lever 255 is on the other or opposite side of the case fixing apparatus 250 from the rotating hook 253, and extends to the contact projection 235 and abuts or contacts the contact projection 235.

Referring to FIGS. 3 to 5, the lever 255 rotates with movement of the contact projection 235 around the rotating shaft 251, and inserts the hook or latch 254 into the hanging part 215 or removes the hook or latch 254 from the hanging part 215.

In accordance with embodiment(s) of the present invention, the button part 231 and the moving part 232 have a moving displacement in the forward and backward directions. As illustrated in FIGS. 5 and 6, the lever 255 also has a displacement that moves downward as the button part 231 and the moving part 232 go forward, and upward as the button part 231 and the moving part 232 go backward.

When the upper surface of the lever 255 contacting the contact projection 235 is horizontal, a contact position between the contact projection 235 and the lever 255 moves forward or backward corresponding to the movement of the button part 231 and the moving part 232 as described above.

According to the structure described above, when the button part 231 moves forward, as illustrated in FIGS. 4 and 6, the contact projection 235 presses the lever 255 downward.

When the lever 255 rotates downward by the downward pressure force, the hook or latch 254 at the opposite side of the lever 255 relative to the rotating shaft 251 is moves upward and is removed from the hanging part 215, thereby releasing the confinement (locked) state of the detergent case 210.

Further, when the button part 231 moves backward, the lever 255 rotates upward as the downward pressure force applied to the lever 255 is reduced or released and the contact projection 235 gradually moves upward.

In this case, the hook or latch 254 opposite from the lever 255 is inserted into the hanging part or opening 215 while moving downward as illustrated in FIGS. 3 and 5, and the detergent case 210 is hung or latched to or caught by the hook or latch 254 to confine the movement (or extraction) thereof.

The pressure member or spring 257 presses or applies a force to the rotating hook 253 or the lever 255 to maintain the hook or latch 254 abutting or contacting (e.g., inserted in) the hanging part or opening 215.

In accordance with the embodiment(s) of the present invention, the pressure member 257 comprises an elastic spring and is below or in contact with the lower portion of the lever 255 to press or force the lever 255 upward.

The lever 255 may be clearly rotatable upward and downward by the movement of the contact projection 235 as contact with the contact projection 235 is stably kept or maintained by the pressure member 257.

Further, when an operation or force pulling the button part 231 forward is released, the lever 255 pushes the contact projection 235 upward as it gradually moves upward by the elastic force of the pressure member 257.

That is, in the locked state as illustrated in FIGS. 4 and 6, after the button 231 is operated or forced downward to release the detergent case 210, the positions of the button part 231 and the hook or latch 254 automatically return to the locked state as illustrated in FIGS. 3 and 5.

Therefore, the user may extract, remove or open the detergent case 210 using both hands only when one hand pulls the button part 231 forward, so that an accident resulting from a child opening or extracting the detergent case 210 due to his/her curiosity may be more stably prevented.

As set forth above, in accordance with embodiments of the present invention, the extraction or opening of the detergent case may be confined by operating a case fixing apparatus including the button part at a position spaced apart from the detergent case.

For example, in accordance with embodiments of the present invention, the detergent case may be opened by operating the button on the side portion of the detergent case or washing machine.

In accordance with embodiments of the present invention, the function of the safety apparatus preventing the child from opening the detergent case and removing the detergent in the detergent case by locking the detergent case as described above may be effectively implemented.

Although the embodiments of the present invention have been described in detail, they are only examples. It will be appreciated by those skilled in the art that various modifications and equivalent other embodiments are possible from the present invention. Therefore, the technical protection scope of the present invention should be defined by the appended claims.

What is claimed is:

1. A washing machine including a detergent case apparatus, comprising:

a washing machine body;

a detergent case configured to be opened and closed, and having a hanging part or opening;

a button on or in the washing machine body; and a case fixing apparatus configured to couple to the hanging part or opening and confine a movement of the detergent case by operation of the button, wherein the button includes:

a button part having an end exposed outside the washing machine body;

a moving part in the washing machine body and connected to the button part; and a guide in the washing machine body and configured to guide movement of the moving part, and wherein the moving part includes:

a support in the washing machine body and connected to the button part;

one or more rails on one side or portion of the support, extending in a moving direction of the support, and abutting or contacting the guide; and a contact projection on another side or portion of the support and abutting or contacting the case fixing apparatus, wherein the case fixing apparatus includes:

a rotating shaft in the washing machine body;

a rotating hook coupled with the rotating shaft and having one end configured to latch to or fit in the hanging part or opening; and a lever connected to another end of the rotating hook, configured to abut or contact the button and move the hook into or away from the hanging part or opening.

2. The washing machine of claim 1, wherein the button part is on a side surface or portion, an upper surface or portion, or a back surface or portion of the washing machine body.

3. The washing machine of claim 1, the contact projection is under the support.

4. The washing machine of claim 1, wherein the guide includes:

one or more first guide hooks or brackets having a surface extending in the moving direction of the support, and configured to abut or contact one side of the support; and a second guide hook or bracket in parallel with the one or more first guide hooks or brackets and configured to abut or contact another side of the support.

5. The washing machine of claim 4, wherein the guide includes a guide projection or rail in parallel with the one or more first guide hooks or brackets and the second guide hook or bracket and configured to abut or contact the one or more rails.

6. The washing machine of claim 1, wherein the case fixing apparatus further includes a pressure member configured to press or apply a force to the rotating hook or the lever to maintain the hook in the hanging part or opening.

7. The washing machine of claim 6, wherein the pressure member comprises a spring.

* * * * *